United States Patent [19]

Kashara

[11] Patent Number: 4,723,146

[45] Date of Patent: Feb. 2, 1988

[54] COLOR ELECTROPHOTOGRAPHIC COPYING APPARATUS

[75] Inventor: Nobuo Kasahara, Yokohama, Japan

[73] Assignee: Ricoh Company, Ltd., Tokyo, Japan

[21] Appl. No.: 728,073

[22] Filed: Apr. 29, 1985

[30] Foreign Application Priority Data

Apr. 27, 1984 [JP] Japan ..... 59-083973

[51] Int. Cl.[4] ..... G03G 15/01; G03G 15/22

[52] U.S. Cl. ..... 355/4; 355/3 R; 430/31; 430/42

[58] Field of Search ..... 430/31, 42; 355/3 R, 355/4

[56] References Cited

U.S. PATENT DOCUMENTS

| | | | |
|---|---|---|---|
| 3,495,903 | 2/1970 | Morley et al. | 355/4 X |
| 3,615,132 | 10/1971 | Turner | 430/31 X |
| 3,615,392 | 10/1971 | Honjo | 430/31 X |
| 4,033,692 | 7/1977 | O'Connell | 355/3 R X |
| 4,537,490 | 8/1985 | Stoudt | 355/3 R |

OTHER PUBLICATIONS

Hider, "Recirculating Master Document Station", IBM Tech., Discl. Bull., vol. 12, No. 8, Jan. 1970, pp. 1227–1228.

*Primary Examiner*—Roland E. Martin

*Attorney, Agent, or Firm*—Oblon, Fisher, Spivak, McClelland, & Maier

[57] ABSTRACT

An electrophotographic copying method of a color separated image superposing transfer-printing system capable of selectively performing a full color copying operation and a single color copying operation. The photosensitive member is exposed to an optical image of an original without compensating for the quantity of light of the optical image both in the full color copying mode and in the single color copying mode, and the processing speeds at which process steps for performing copying are followed are changed in such a manner that the photosensitive member is subjected to an exposure for each of the two modes. Changing the speeds is effected automatically in conjunction with the selection of one of the two modes.

3 Claims, 7 Drawing Figures

BLUE FILTER

GREEN FILTER

RED FILTER

COLOR ELECTROPHOTOGRAPHIC COPYING APPARATUS

FIELD OF THE INVENTION

This invention relates to a color electrophotographic copying method of a color separated images superposing transfer-printing system which is capable of producing both a full-color copy and a copy of each one of a variety of single colors.

DESCRIPTION OF THE PRIOR ART

Figure 1:
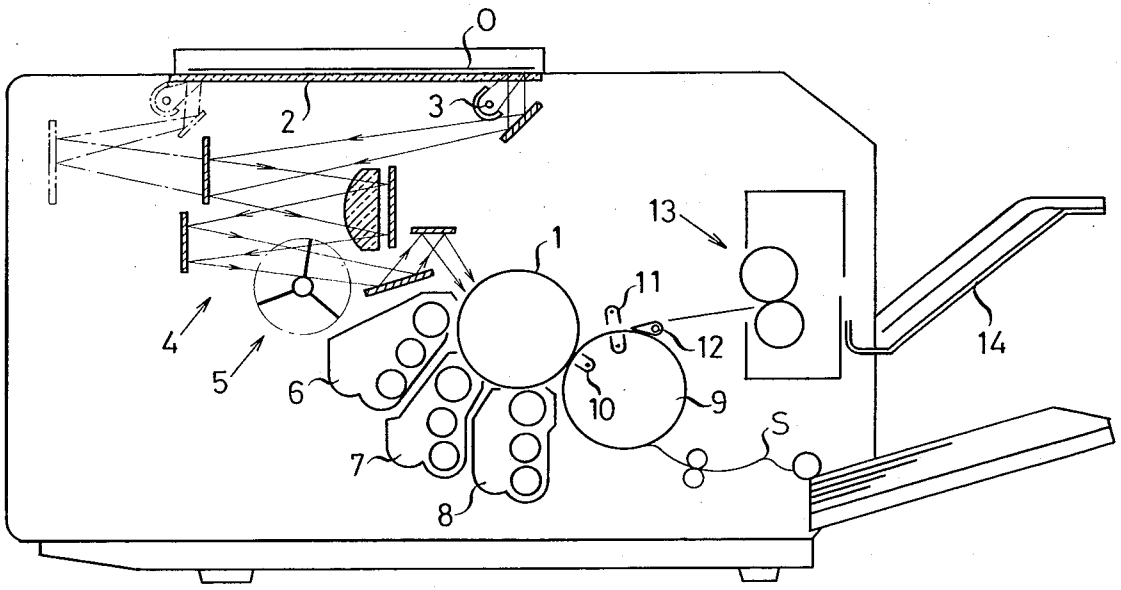
FIG. 1 is a schematic sectional view of one example of the color electrophotographic copying apparatus of a color separated images superposing transfer-printing system suitable for carrying into practice the color electrophotographic copying method according to the invention.

FIG. 1 shows in a schematic sectional view a color electrophotographic copying apparatus of a color separated images superposing transfer-printing system. When this apparatus is used, a full-color copy is produced after a photosensitive drum 1 has made three complete revolutions. In the apparatus, a document or an original O is placed on a contact glass member 2 and irradiated by an exposing lamp 3 to form an optical image of the original O which is passed through a color separation filter 5 of blue, green and red, respectively, inserted in an optical path of an exposing optical system 4 to expose a photosensitive surface of the photosensitive drum 1 to the three color components of the optical image, to successively form three electrostatic latent images of separate color components on the photosensitive member 1. Developing devices 6, 7 and 8 provided with developing agents containing toners of yellow, magenta and cyan, respectively, are located around the photosensitive drum 1 in a developing station which is adjacent exposing station. An electrostatic latent image formed by a component of the optical image transmitted through the blue color filter is developed by the developing device 6 having the yellow toner to produce a toner image which is printed by transfer-printing by means of a transfer-printing charger 10 in a transfer-printing drum 9 on a transfer-printing sheet S wound on the transfer-printing drum 9 located in contact with the photosensitive drum 1 and rotating in synchronism therewith at the same peripheral velocity in a transfer-printing station adjacent the developing station. Then, an electrostatic latent image formed by the optical image transmitted through the green color filter is developed by the developing device 7 having the magenta toner to provide a toner image which is printed on the same transfer-printing sheet S on the photosensitive drum 1 in superposed relation to the toner image formed with the yellow toner after the photosensitive member 1 had made one complete revolution following the printing of the toner image formed with the yellow toner. Thereafter, an electrostatic latent image formed by the optical image transmitted through the red filter is developed by the developing device 8 having the cyan toner to form a toner image which is printed on the same transfer-printing sheet S in superposed relation to the toner images formed with the yellow and magenta toners. The transfer-printing sheet S on which the toner images formed with toners of three colors have been printed in superposed relation to each other to form a toner image of full color is separated from the transfer-printing drum 9 by means of a separating charger 11 and a separating claw 12, and the toner image of full color is fixed by a fixing device 13, before the transfer-printing sheet S is ejected onto a tray 14 located outside the apparatus, thereby finishing the production of a full color copy of the original O.

It is possible to produce a copy of a single color by using the color electrophotographic copying apparatus of the construction described hereinabove. The colors in which a copy can be produced include, in addition to yellow, magenta and cyan, those colors which can be produced by mixing two of these three colors, and the color that can be produced by mixing all the three colors. That is, the seven colors in which a copy of a single color can be obtained are as follows:

Yellow;
Magenta;
Cyan;
Yellow+Magenta=Red;
Magenta+Cyan=Blue;
Yellow+Cyan=Green; and
Yellow+Magenta+Cyan=Black.

A copy of a single color can be produced as follows. When the copy to be produced is yellow, magenta or cyan in color, the photosensitive drum 1 is exposed to an optical image of the original O in black and white or in some other color without passing through the color separation filler 5 to form an electrostatic latent image which is developed by the developing device containing the toner of the desired color into a toner image which is printed by transfer-printing on the transfer-printing sheet S and fixed. When the copy of a single color to be produced is in a color obtained by mixing two or three toners of different colors, the photosensitive drum 1 is exposed to an optical image of the original O a number of times corresponding to the number of toners of the colors to be mixed without passing the optical image through the color separation filter 5, and an electrostatic latent image is developed each time it is formed with a toner of one of the colors to be mixed to form a toner image of a desired color which is printed by transfer-printing in superpose relation on the transfer-printing sheet S and fixed. The printing operation is finished when a printed image of a desired color obtained by mixing two or three colors is fixed.

When an attempt is made to produce a full-color copy, an optical image of the original O is passed through the color separation filter 5 for blue, green and red colors to produce superposed latent images which are developed with toners of yellow, magenta and cyan colors as described hereinabove. In this case, a copy of purely black color or dark color might fail to meet the required standards, due to the spectro-reflection characteristics of the toners used or other factors. To obviate this disadvantage, proposals have been made to use a filter having a yellow color in addition to the blue, green and red color filters and also to use a developing device provided with a developing agent including a black toner, so that the photosensitive surface will be exposed to an optical image four times and a latent image formed by exposing the photosensitive drum to an optical image transmitted through the yellow color filter will be developed by a black toner to effect transfer-printing by superposing toner images of four different colors one over another. When the developing device provided with a black toner is used, the production of a copy of a single color or a black and white copy is facilitated because the end can be attained by merely exposing the photosensitive drum to an optical image of the original only once without passing the optical image through the filter to produce a latent image, and by developing the latent image by the black toner and fixing the black toner image formed.

In the color electrophotographic copying apparatus of the aforesaid system of the prior art the processing speed at which a series of copying process steps are performed is set at a constant value. Thus, the period of time required for producing a black and white copy or a copy of a single color selected from the group consisting of yellow, magenta and cyan colors by a copying apparatus provided with developing devices having yellow, magenta, cyan and black toners respectively will be one-third and one-fourth the period of time required for producing a full-color copy by superposing toner images of three colors and toner images of four colors, respectively, one over another because the production of a copy of a single color requires only one series of exposing, developing and transfer-printing steps to be performed.

Figure 2A:
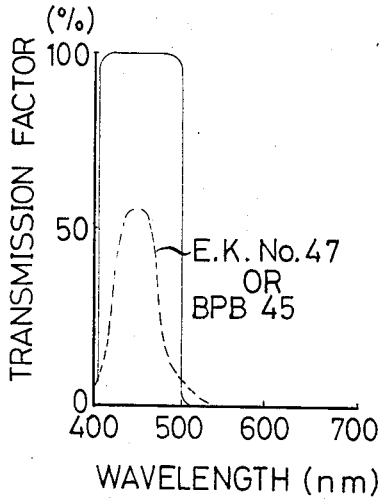
FIGS. 2(*a*), 2(*b*) and 2(*c*) are diagrams each showing a curve representing the spectro-transmission factor characteristic of each color separation filter used with the color electrophotographic copying method according to the invention.
Figure 2B:
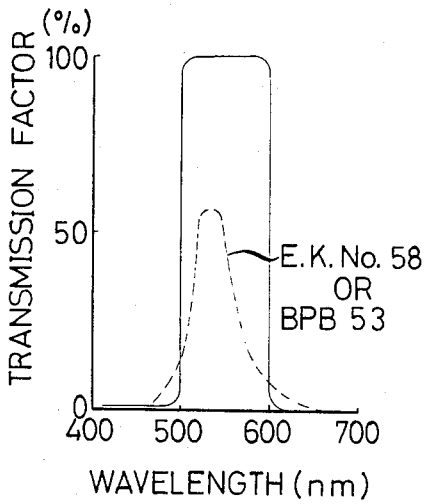
Figure 2C:
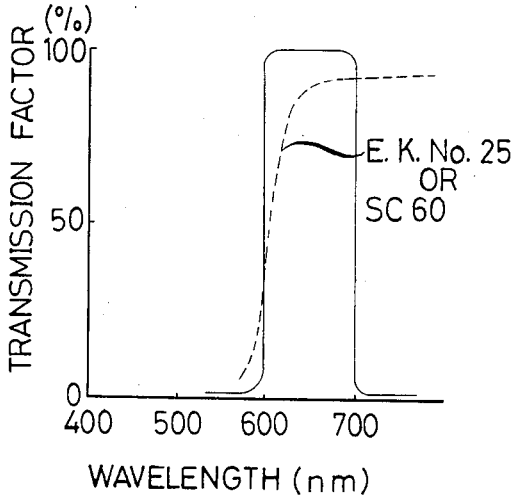

In the color electrophotographic copying apparatus of the color separated images superposing transfer-printing system constructed as described hereinabove, it has hitherto been customary to use, as the color separation filters having the blue, green and red color, Latten Nos. 47, 58 and 25 of Eastman Kodak Company or bandpass filters BPB-45, BPB-53 and a sharp-cut filter SC-60 of Fuji Photo Film Company, respectively. As shown in FIGS. 2(*a*), 2(*b*) and 2(*c*), the spectro-transmission factors of these filters have characteristics such that, as represented by broken lines, they are considerably lower than the spectro-transmission factors, designated by solid lines, of the ideal blue, green and red color separation filter (a filter having a plurality of layers formed by vaporization deposition in a vacuum is essentially similar to the ideal filter).

Figure 3A:
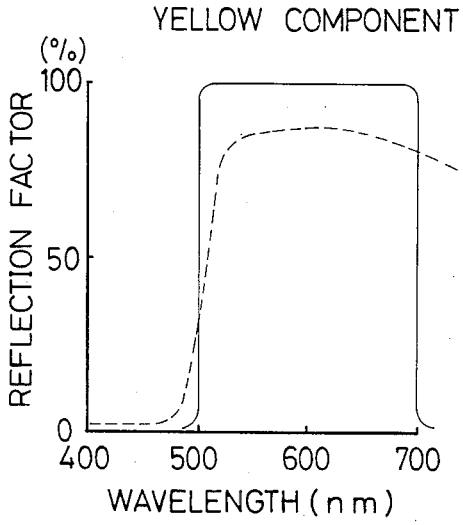
FIGS. 3(*a*), 3(*b*) and 3(*c*) are diagrams each showing a curve representing the spectro-reflection factor characteristic of a toner of each color used with the color electrophotographic copying method according to the invention.
Figure 3B:
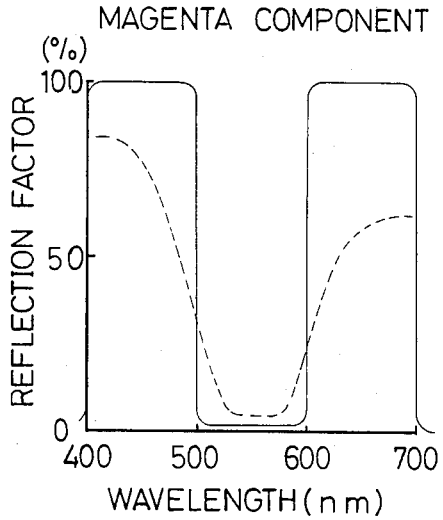
Figure 3C:
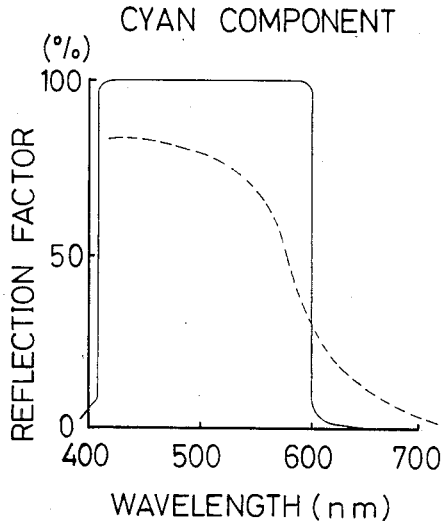

As shown in FIGS. 3(*a*), 3(*b*) and 3(*c*), the spectro-reflection factors of the actual yellow, magenta and cyan toners have characteristics such that, as represented by broken lines, they have high absorption ratios of color components that should be reflected than ideal toners designated by solid lines. Thus, when toner images of these three colors are placed in superposed relation one over another and subjected to transfer-printing, the color of the copy might become blurred. To avoid this phenomenon, it has hitherto been usual practice to overexpose the photosensitive drum to an optical image of the original in forming electrostatic latent images in three colors.

When ideal color separation filters were used and the exposure of the photosensitive drum to an optical image of the original were kept at a regular level, the transmission factor of the optical image would be reduced to a level which would be one-third that of the transmission factor of the optical image obtained when no filter is used, because the bandwidth of the wavelength of each color separation filter is one-third that of the visible region (400–700 nm). Thus, when exposing is effected by using the same exposing lamp but without passing the optical image through the color separation filter, the intensity of illumination on the photosensitive drum would be three times as high as that obtained when the optical image is passed through the filter. Moreover, owing to the two factors noted hereinabove, the intensity of illumination would increase more than threefold, resulting in a substantial degree of overexposure. This would make it impossible to produce a copy of high quality which is acceptable in appearance.

To compensate for the exposure when an optical image of an original is not passed through a filter in a single color printing mode, proposals have hitherto been made to adopt the following measures:

(a) Inserting a neutral density filter (ND filter) in an exposing optical path;
(b) Reducing the voltage impressed on the exposing lamp;
(c) Stopping down the lens; and
(d) Reducing the width of the exposing slit.

However, these proposals also suffer disadvantages. Even if these proposals are adopted, the period of time required for forming an image of one color is not much different from the period of time required for forming a image of one color for producing a copy of full color, in spite of the fact that the quantity of light is increased by eliminating the use of the color separation filter. Using the ND filter, stopping down the lens and reducing the width of the exposing slit might induce a loss of power.

SUMMARY OF THE INVENTION

This invention has been developed for the purpose of obviating the aforesaid disadvantages of the proposals that have been made in the prior art to compensate for the exposure when a copy of a single color is produced by using the color electrophotographic copying apparatus of the color separated images superposing transfer-printing system. Accordingly, the invention has as its object the provision of a color electrophotographic copying method capable of producing a copy at high speed without wasting power.

The aforesaid object is accomplished by providing the color electrophotographic copying method of the color separated images superposing transfer-printing system with the feature of changing the processing speeds at which process steps for performing copying are followed in a full color copying mode and a single color copying mode in such a manner that an optimum exposure can be obtained for each of the two modes by exposing the photosensitive member to an optical image of an original without compensating for the quantity of light of the optical image to which the photosensitive member is exposed.

DESCRIPTION OF THE PREFERRED EMBODIMENT

A preferred embodiment of the invention will now be described as being carried into practice by using the color electrophotographic copying apparatus shown in FIG. 1 and the copying apparatus described hereinabove which includes four color filters and four developing devices.

A copying apparatus used for carrying the method according to the invention into practice is provided with means for automatically changing the processing speeds at which process steps for performing copying are performed in a full color copying mode and a single color copying mode in conjunction with switching the copying apparatus between a single color copying mode and a full color copying mode.

The operation will be described in detail. In a single color copying mode, a photosensitive member is exposed to an optical image of an original without passing the optical image through a color separation filter, as described in the description of the prior art. Thus, if the period of time in which exposing is effected remained unchanged for the two copying modes without effecting compensation of the exposure either by using an ND filter, by stopping down the lens or by changing the voltage impressed on the exposing lamp, the exposure to which the photosensitive member is subjected would be more than three times as great as that in a full color copying mode in which the optical image is passed through the color separation filter. Moreover, in the single color copying mode, it is not necessary to resort to overexposing to prevent blurring of the color which is necessary in the full color copying mode. Thus, in the single color copying mode, the period of time for effecting exposing could be much shorter than one-third that for effecting exposing in the full color copying mode, to impart a suitable exposure to the photosensitive member. Accordingly, the velocity at which the photosensitive member is rotated, if it is in drum form, could be raised to a level about three times as high as the level in the full color copying mode so far as the exposure is concerned.

If the velocity at which the photosensitive drum is rotated were increased, it would be necessary to raise the voltages impressed on the chargers for charging the photosensitive surface of the photosensitive drum and for effecting transfer printing and to raise the speed at which the developing agents are fed to the developing devices to vary the conditions under which the copying process is performed, in order that the process steps of charging, developing, transfer-printing, fixing and removing the charge might be performed without any trouble. However, technically speaking, this would pose no problem. Therefore, by providing means for automatically changing the velocity at which the photosensitive drum is rotated, the speed at which a transfer-printing sheet is fed and the conditions under which the process steps for performing copying are followed, in conjunction with switching the copying apparatus between the full color copying mode and the single color copying mode, it is possible to smoothly perform copying to produce both a full color copy and a single color copy.

As a result, it is possible to reduce the period of time required for performing a single exposing operation in the single color copying mode to a level below one-third the period of time required for performing a single exposing operation in the full color copying mode.

This is conducive to a reduction in the period of time for switching on the exposing lamp, resulting in a reduction in the consumption of power. In the single color copying mode, only one developing device is actuated, so that the number of times the exposing operation is performed is below one-third or one-fourth the number of times the exposing operation is performed in the full color copying mode. All in all, the period of time required for producing one copy in the single color copying mode is reduced to a level below one-tenth the period of time required for producing one copy in the full color copying mode.

From the foregoing description, it will be appreciated that, in the electrophotographic copying method according to the invention, the period of time required for producing one copy in the single color copying mode is greatly reduced as compared with the period of time required in the prior art. This is conducive to improved copying efficiency and reduced power consumption. Thus, the invention contributes to energy conservation.

What is claimed is:

1. In a color electrophotographic apparatus for selectively producing a color copy in either a full color copying mode or a single color copying mode, of the type having a cyclically moving photosensitive member, an exposing optical system for exposing the photosensitive member to an optical image of an original, a plurality of color separation filters for selective insertion in the optical path of the optical exposing system, a plurality of developing means each provided with a developer of a predetermined color, and transfer means for transferring a developed image from the photosensitive member to a transfer sheet, said apparatus being operated in the full color copying mode by successively exposing the photosensitive member to an original a plurality of times through selected color separation filters inserted in the optical path of the exposing optical system, developing each exposure with a developer of corresponding color, and transfering each developed image to a transfer sheet in superposed relation, and said apparatus being operated in the single color copying mode by exposing the original one or more times without insertion of color separation filters, developing at least said one exposure with a developer of a selected color, and transfering the developed image to a transfer sheet, the improvement comprising means for operating said apparatus in the full color copying mode at one processing speed, and for operating said apparatus in the single color copying mode at a higher processing speed, said higher processing speed being set to take into account a difference of exposure without said color separation filters in the single color copying mode.

2. A color electrophotographic copying apparatus as claimed in claim 1, wherein said operating means changes said processing speeds automatically upon selection of said full color copying mode or said single color copying mode.

3. A color electrophotographic copying apparatus as claimed in claim 1, wherein said operating means changes said processing speed, including a rotating velocity of said photosensitive member, in said single color copying mode three times or more higher than the processing speed in said full color copying mode.

* * * * *